United States Patent [19]

Castellini

[11] Patent Number: 4,722,566

[45] Date of Patent: Feb. 2, 1988

[54] RECLINING CHAIR FRAME WITH ADJUSTABLE SEAT AND BACK-REST, IN PARTICULAR FOR USE IN DENTISTRY

[75] Inventor: Franco Castellini, Bologna, Italy

[73] Assignee: Castellini S.p.A., Bologna, Italy

[21] Appl. No.: 923,910

[22] Filed: Oct. 28, 1986

[30] Foreign Application Priority Data

Jul. 18, 1986 [IT] Italy ..... 3465 A/86

[51] Int. Cl.[4] ..... A47C 1/02

[52] U.S. Cl. ..... 297/68; 297/330; 297/DIG. 10

[58] Field of Search ..... 297/68, 330, DIG. 10; 248/421

[56] References Cited

U.S. PATENT DOCUMENTS 3,596,982 8/1971 Grams ..... 297/330 X
3,804,460 4/1974 Leffler ..... 297/330 X
4,173,372 11/1979 Norris ..... 297/330 X

FOREIGN PATENT DOCUMENTS 0017914 10/1980 European Pat. Off. ..... 248/421

*Primary Examiner*—James T. McCall
*Attorney, Agent, or Firm*—Laff, Whitesel, Conte & Saret

[57] ABSTRACT

The reclining chair frame disclosed is for use principally in dentistry, and has an adjustable seat and back-rest, the seat connecting with the base at one side, or both, by way of two struts that converge slightly toward the top ends and form an articulated quadrilateral with the seat and base. One of the struts extends upwards and is hinged to a connecting link, this hinged in turn to the back-rest at a point lower than the point at which the back-rest itself is hinged to the seat. An actuator impinges on the remaining strut, rotating it about the pivot by which it is anchored to the base in such a way that the chair is maneuvered through an infinitely variable range of adjustments from a normal sitting position, with the back-rest upright, to a fully reclined position in which the back-rest is disposed substantially horizontal and the seat ultimately positioned above the level of the back-rest.

7 Claims, 2 Drawing Figures

RECLINING CHAIR FRAME WITH ADJUSTABLE SEAT AND BACK-REST, IN PARTICULAR FOR USE IN DENTISTRY

BACKGROUND OF THE INVENTION

The invention relates to a reclining chair frame of the type, in particular, used in dentistry.

Conventional chair frames with adjustable seat and back-rest, especially those installed in dentists' surgeries, consist fundamentally of a base, seat, and back-rest; the seat is carried by the base, and the back-rest hinged to the seat. Such chairs provide three basic adjustments, namely, raising and lowering of the seat (height), back-rest angle (rake), and simultaneous rotation or tilt of seat and back-rest (posture). Separate controls are provided for the three types of movement.

A chair of this kind is singularly useful for the purposes of dental treatment, since it enables the dentist to maneuver the patient from a sitting to a reclining position as and when may be necessary, according to the type of treatment being carried out.

Nonetheless, the conventional design of chair frame presents the drawback that increased rake causes the patient's head to move away through, in effect, a circular arc, thus becoming distanced from the point occupied by the dentist. This problem is heightened by the fact that the modern surgery contains numerous items of equipment, generally laid out in a circumferential array having its center at the spot normally occupied by the dentist, in the interests of ergonomic efficiency. It follows therefore, that if the position of the patient's head is altered, the dentist must necessarily stray from his/her preferred station, i.e. the point from which all of the various items of equipment can be reached without difficulty.

In practice, certain operations are carried out with the patient in a sitting position, whereas others require a reclining position; it becomes impossible, therefore, to establish an exact station for the dentist to adopt with the end in view of laying out equipment to best advantage.

Another requirement that may be encountered during a session of treatment is that of having to arrange the patient in haste with his/her head positioned on a level below that of the legs. This posture, known in medical circles as the Trendelenburg, is provided for in certain conventional types of chair, but obtainable only by way of additional movements and controls that complicate the chair's construction of the chair, and in addition to the disadvantage of a complicated structure, one has the drawback that a dentist will in practice use such a facility but rarely, and thus not always achieve its operation with the requisite speed.

The object of the invention disclosed is that of embodying a reclining chair frame with an adjustable seat and back-rest, in particular for use in dentistry, that is free from the drawbacks thus described.

SUMMARY OF THE INVENTION

In a chair as disclosed and claimed herein, the stated object is achieved by adoption of a frame in which the seat is carried by the base on pairs of upwardly converging struts, one such pair to each side of the seat, that combine with the base and seat in creating an articulated quadrilateral.

According to the invention, an upward extension of one of the struts hinges with a connecting link that is hinged in its turn to the back-rest at a level lower than that at which the seat and back-rest are hinged together, such that rotation of the struts in the clockwise direction will produce a corresponding anticlockwise rotation of the back-rest. Rotational movement is obtained by way of an extendable and retractable actuator one end of which is attached to one of the struts, and the other, to that part of the base with which the struts pivotably associate.

One of the advantages of the invention consists in having succeeded in embodying a simple, functional structure in which rotational movement of the back-rest is accompanied by forward movement of the seat, thereby confining the movement of the patient's head to a vertical path, for all practical intents and purposes.

Another advantage of the chair disclosed is that the facility exists of obtaining Trendelenburg position utilizing a single, universal control that reclines the back-rest and moves the seat forward in one and the same maneuver. The dimensions of the struts are such, that the back-rest is taken through infinitely variable rake from a first position, near upright, to a second, essentially horizontal, while the seat is angled progressively in relation to the back-rest to the point where it assumes an elevated position with respect thereto.

A further advantage of the invention is that it provides the facility of using one and the same control to produce rotation of the foot-rest into a horizontal position, simultaneously with the reclining movement of the seat and back-rest.

BRIEF DESCRIPTION OF THE DRAWINGS

The invention will now be described in detail, by way of example, with the aid of the accompanying drawings in which.

DESCRIPTION OF THE PREFERRED EMBODIMENT

Figure 1:
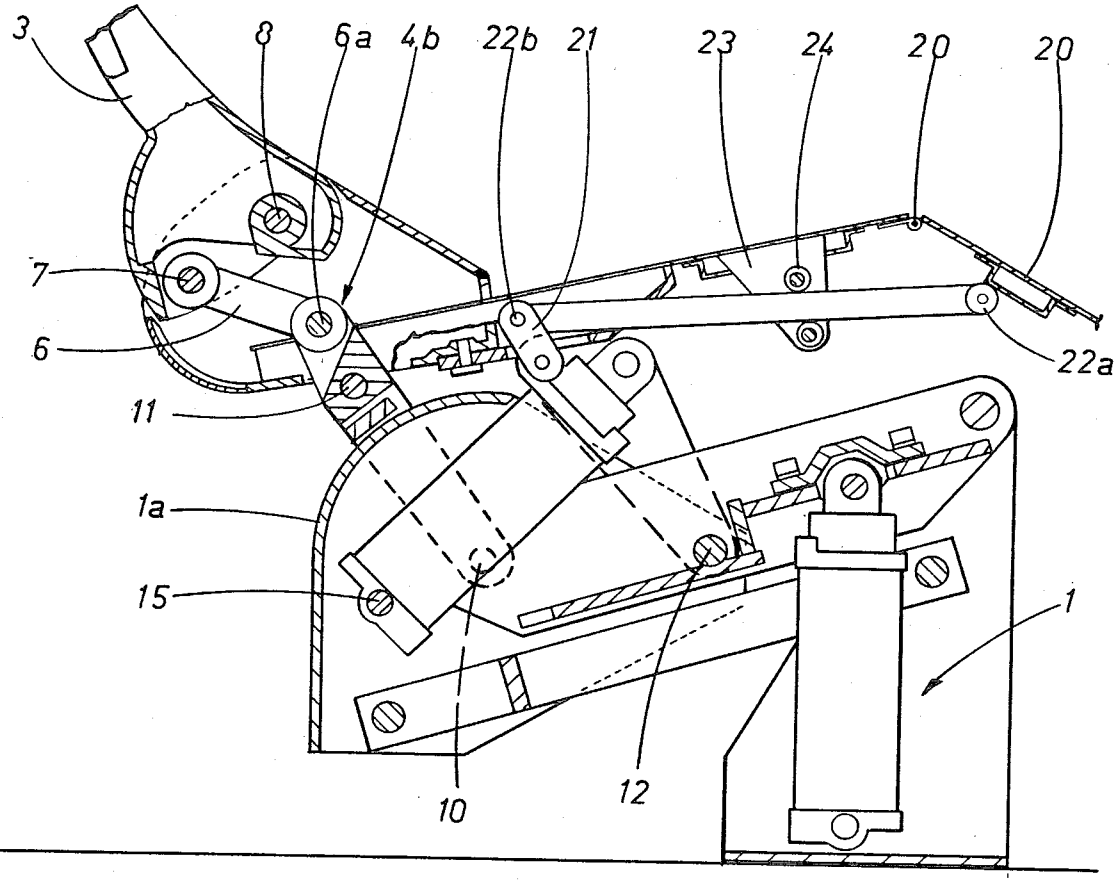
FIG. 1 is a side elevation of the reclining chair frame disclosed, viewed in the configuration assumed with the patient in a sitting position.

With reference to the accompanying drawings, a chair with adjustable seat and back-rest of the type, in particular, used in dentistry, consists essentially in a base 1, and two supports denoted 2 and 3 which are hinged together and carry the seat and back-rest proper. For the sake of simplicity, these supports will be directly referred to as the seat 2 and back-rest 3, respectively.

The seat 2 is supported by the base 1 in such a way as to permit of its being raised and lowered; since, however, the type of base which produces this up and down movement of the seat 2 constitutes prior art, no description is included.

According to the invention, the seat 2 is carried by the base 1 on a pair of struts 4 and 5 that converge slightly toward the top and are hinged to the base 1 via pivots denoted 10 and 12, and to the seat 2 via respective pivots denoted 11 and 13. The struts 4 and 5, the section 1*a* of the base 1 to which they are pivotably attached, and the seat 2, combine to create an articulated quadrilateral.

Depending on the individual type of chair, one may have two struts 4 and 5 at either side of the seat, or at one side only.

The seat 2 consists in a horizontal part 2*a* to which the top pivots 11 and 13 of the struts 4 and 5 are anchored, and two upright side pieces 2*b* (or one) each one of which provides the anchor for the pivot 8 of the back-rest 3 (one such side piece 2*b* only is visible in the drawings).

In the embodiment illustrated, each strut denoted 4 extends upward through a stretch 4*a* the projecting end 4*b* of which is hinged via a pivot 6*a* to one end of a connecting link 6. The remaining end of the connecting link 6 is hinged to the back-rest via a pivot 7 positioned at a lower level than the main bearer pivot 8 between seat and back-rest. The struts denoted 5 in the example illustrated are interconnected at respective points intermediate of their hinge pivots 12 and 13 by a horizontal bar 9 to which one end of an actuator 14 is hinged, its other end 15 pivoted to the section 1*a* of the base 1 that provides the anchor for the bottom pivots 10 and 12 of the struts 4 and 5.

The actuator 14 appears in the drawings as a fluid power cylinder, though its ultimate embodiment is a matter of choice, the requirement being simply that the two relative pivots 9 and 15 can be drawn together and spread apart.

The dimensions of the struts 4 and 5 and of the connecting link 6, and the distance separating the hinge pivots 7 and 8 associated with the back-rest 3 will be proportioned according to the chair's overall dimensions. At all events, the dimensions and the clearance in question are established such that a given point on the moving back-rest 3, which coincides, in effect, with the position of the head of a patient of average height (denoted A in the drawing, by way of example), will be displaced, for all practical intents and purposes, through a given vertical plane. Marginal deviation from the vertical can be considered acceptable, however.

Figure 2:
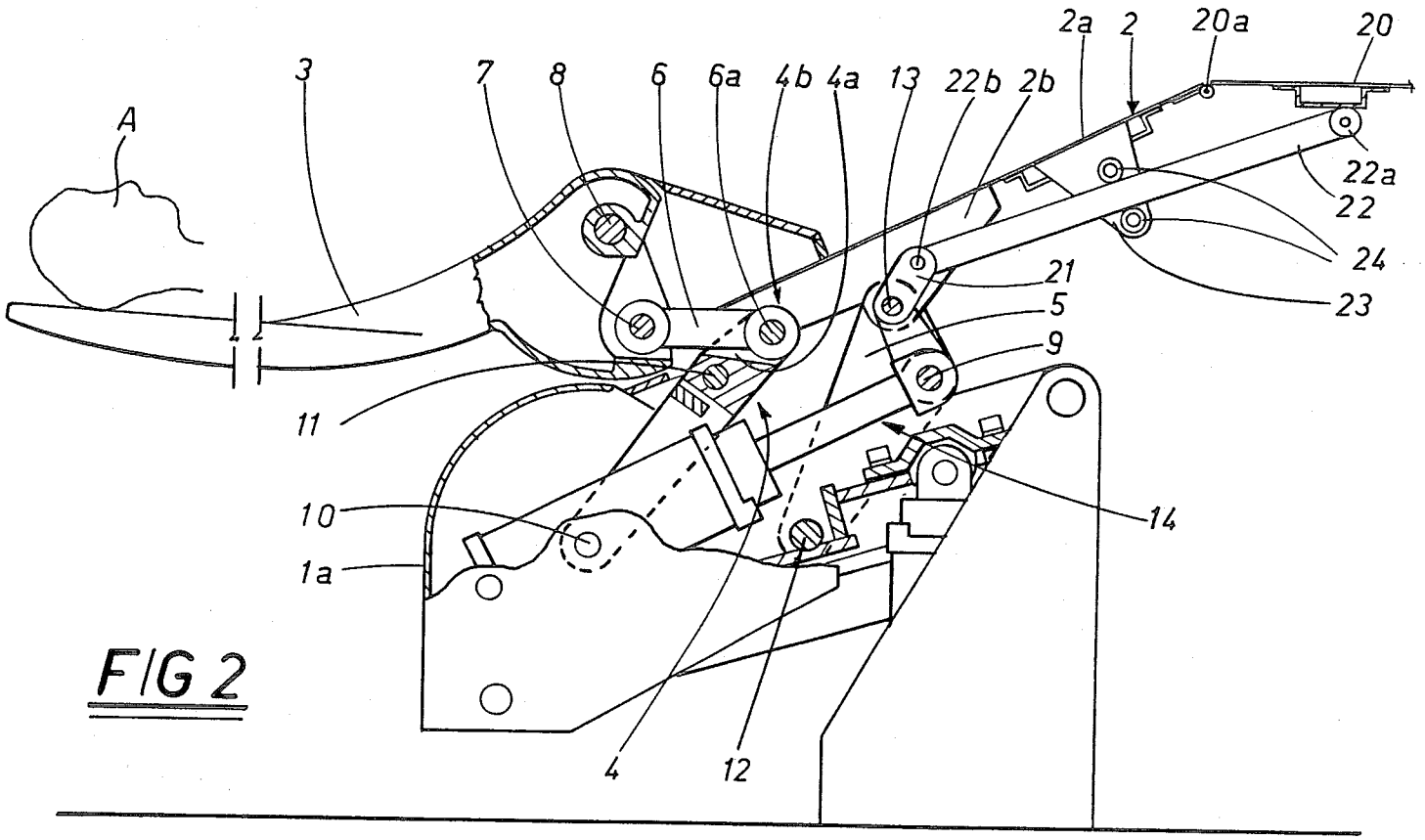
FIG. 2 is the same side elevation, showing the chair in the configuration assumed with the patient in a reclining posture.

The same dimensions and clearance must also be such that a single stroke of the one actuator 14 produces rotation of the adjustable back-rest 3 from a first, substantially vertical limit position, in which the patient settles in a sitting posture (see FIG. 1) and the angle of the seat is that nearest to the horizontal, through an infinitely variable range of positions in which the angle of rake increases and the seat traverses forward so as to offset the vertical position of the patient's head, remaining at substantially the same angle nonetheless, to a second limit position, in which the back-rest 3 is almost horizontal, the patient assumes a reclining posture (see FIG. 2), and the seat 2 is discernably angled and raised above the level of the back-rest.

Thus, rotational movement of the back-rest 3 occurs simultaneously with the traversing movement of the seat 2; however, given the difference in length of the struts 4 and 5, the angle of the seat is more accentuated and more swiftly assumed as the back-rest approaches its limit position.

This same position is known conventionally as the Trendelenburg, and is gained only during the closing stages of the extending stroke of the fluid power cylinder 14. In effect, Trendelenburg position will be used only rarely in the general course of events, but if required, it suffices simply to take the fluid power cylinder 14 to full extension, without operating any special or auxiliary controls.

In the embodiment illustrated, the strut denoted 5 is rigidly associated with a respective connecting link 21, the remaining end of which is hinged to one end of an elongated member 22 via a relative pivot 22*a*. The elongated member 22 is supported and guided by two round horizontal and parallel bars 24 carried by two vertical lugs 23 attached to the bottom of the flat part 2*a* of the seat 2.

The projecting end 22*a* of the elongated member 22 provides the slidable support for a foot-rest 20 hinged about a pivot 20*a* at the front edge of the flat part 2*a* of the seat 2. The connecting link 21 is located above the relative strut 5 and is of length such as to produce gradual rotation of the foot-rest 20 from an angled position (FIG. 1) to an almost horizontal position (FIG. 2) as the actuator 14 progressively extends. Such a change in position occurs in harmony with that of the chair as a whole, the movement of the foot-rest enhancing effectiveness of the position gained by the back-rest 3 and the seat 2, as the patient reclines fully with his/her legs in a horizontal position above the level of the head A.

Accordingly, the chair is adjustable, by operation of the actuator 14, through an infinitely variable range of positions, those described above being the most worthy of note.

The succession of movements and positions of the seat 2 thus illustrated is obtained by virtue of the special linkage of the struts 4 and 5, and their dimensions, within the framework of the articulated quadrilateral. As the drawings illustrate, the hinge pivot 10 of the one strut 4 is located at a lower level than the corresponding pivot 12 of the other strut 5, whilst the length of the self-same strut 4 between its two pivots 10 and 11 is less than that of the second strut 5 between its pivots 12 and 13; the two struts 4 and 5 also exhibit a slight upward convergence, as aforementioned. Accordingly, during the greater part of the struts + rotation, the hinge pivots 11 and 13 anchored to the seat 2 will remain substantially at the same relative height, whilst in the final stages of rotation, the pivot 13 nearest the foot-rest will be raised to a greater height than that of the pivot 11 nearest the back-rest.

What is claimed:

1. Reclining chair frame with a height adjustable seat portion and back-rest portion, comprising:

a base constructed to support and operate the height-adjustable seat to which the backrest is pivotable attached, at least one pair of struts lying in a vertical plane, and hinged at their opposite ends to the base and to the seat respectively to form an articulated quadrilateral with the base and seat;

a connecting link, one end of which is pivotably attached to a top most part of one of said struts, the other end of the connecting link attached rotatably to a pivot anchored to the back-rest, in such a way that the two pivoted ends of the link are located on either side of a vertical plane passing through the pivot connecting the back-rest and the seat, when the back-rest is in an upright position;

an extendable and retractable actuator, one end of which is hinged to and between the ends of the other strut, the other end of said actuator hinged to the section of the base to which both struts of the pair are pivotably attached, said struts, connecting link and actuator being so attached and positioned to rotate the articulated quadrilateral at least between a first limit position, an intermediate position and a second limit position, in said first limit position the back-rest is substantially vertical and the seat substantially horizontal, in said intermediate position the back-rest is substantially horizontal and the seat likewise substantially horizontal, and in said second limit position the seat is angled and raised above the level of the back-rest, which remains substantially horizontal.

2. Reclining chair frame as in claim 1, the struts and the connecting link of which exhibit dimensions such that a point near to the top end of the back-rest moves substantially in a vertical line when the struts are rotated.

3. Reclining chair frame as in claim 1 or 2 comprising a footrest pivotably attached to the front of the seat, wherein said other strut is pivotably attached to one end of an elongated member slidably supported by the underside of the seat, a projecting end of the elongated member slides beneath and supports the footrest, and wherein the pivot is located at a point above the pivot connected the other strut with the seat and the length of the elongated member is such that the footrest is taken from an angled position to an almost horizontal position as a result of the articulated quadrilateral moving from one limit position to the second limit position.

4. Reclining chair frame as in claim 1 or 2, wherein the connecting link is pivotably attached to the strut located nearest to the back-rest.

5. Reclining chair frame as in claim 1, wherein the connecting link is hinged to the back-rest by way of a pivot located at a height lower than that of the pivot which connects the back-rest and seat.

6. Reclining chair frame as in claim 3, wherein the elongated member hinges with the strut located nearest to the foot-rest.

7. Reclining chair frame as in claim 1, wherein said one strut is the strut nearest the backrest and the distance measured between its base and seat pivots is less than the distance measured likewise between the corresponding pivots of the other strut, and wherein the pivot that connects the other strut with the base is located at a level lower than that of the pivot that connects the one strut with the base.

* * * * *